United States Patent [19]

Hack

[11] Patent Number: 4,828,407

[45] Date of Patent: May 9, 1989

[54] CIRCUIT FOR IMPROVING THE RESOLUTION IN ELECTROSTATIC PRINTERS

[75] Inventor: James R. Hack, Villa Park, Calif.

[73] Assignee: Sanders Associates, Inc., Nashua, N.H.

[21] Appl. No.: 55,734

[22] Filed: May 29, 1987

[51] Int. Cl.[4] ..... B41J 3/18

[52] U.S. Cl. ..... 400/119; 307/318; 400/121; 101/DIG. 13; 101/DIG. 37

[58] Field of Search ..... 400/118, 119, 120, 121; 101/DIG. 13; 346/153.1, 154, 155, 160.1; 118/620, 621, 624, 625, 644; 307/281, 318, 319, 320

[56] References Cited

U.S. PATENT DOCUMENTS

| | | | |
|---|---|---|---|
| 3,631,509 | 12/1971 | Marshall | 346/154 |
| 3,732,573 | 5/1973 | Merka et al. | 346/154 |
| 3,792,495 | 2/1974 | Bliss et al. | 346/154 |
| 3,875,892 | 4/1975 | Gregg et al. | 101/DIG. 13 |
| 4,115,763 | 9/1978 | Brown, Jr. et al. | 346/154 X |
| 4,141,018 | 2/1979 | Mizuguchi et al. | 400/120 X |

FOREIGN PATENT DOCUMENTS

| | | | |
|---|---|---|---|
| 0034933 | 3/1980 | Japan | 400/120 |
| 0164177 | 12/1980 | Japan | 400/120 |
| 0156282 | 9/1982 | Japan | 400/120 |
| 0176184 | 10/1982 | Japan | 400/120 |
| 0024466 | 2/1983 | Japan | 400/120 |
| 0002386 | 1/1985 | Japan | 400/120 |

*Primary Examiner*—Ernest T. Wright, Jr.
*Attorney, Agent, or Firm*—Nutter, McClennen & Fish

[57] ABSTRACT

A plurality of switched voltage sources (10, 10', 10'') apply charge to a sheet of paper (16) by way of respective sets of styli (12, 12', 12''). To print a dot when toner is subsequently applied to the paper, the voltage source (10) deposits charge on the paper (16) by applying a high voltage, and its voltage returns to ground when it is to avoid leaving a mark. In order to avoid the image degradation that results from the proximity of an unenergized stylus to an energized one, a zener diode (14) is interposed between the switched voltage source (10) and its respective styli (12). By virtue of stray capacitance ($C_s$) between the styli (12) and ground, the potential of the styli does not return completely to ground when their respective voltage source is switched off. Instead, it returns only to the zener voltage, and this reduces the image degradation that the presence that the unenergized styli would otherwise cause.

2 Claims, 1 Drawing Sheet

CIRCUIT FOR IMPROVING THE RESOLUTION IN ELECTROSTATIC PRINTERS

BACKGROUND OF THE INVENTION

1. Field of the Invention

This invention relates to an electrostatic printer of the type that employs an array of styli to impress a dot-like pattern of electric charge on a recording medium such as a sheet of paper. Toner is subsequently applied to the recording medium to provide a visible image of the charge pattern. The invention relates to improved control of the size and shape of the dots impressed on the recording medium by the styli.

In printers of the type to which the invention relates a sheet of paper is passed beneath an array of electrically conducting styli. The styli are individually energized with high voltage pulses, thereby leaving dots of electric charge on the paper, the dots being applied in a pattern corresponding to the image to be recorded. In printers of this type it is desirable that the dots be well defined so that one can record a faithful reproduction of a desired image. Unfortunately, these printers have heretofore been characterized by dots which are not sufficiently controlled, either as to size or to shape, thereby undesirably degrading the recorded image.

SUMMARY OF THE INVENTION

I have found that the problem of dot control stems from interaction between an energized stylus and the neighboring styli that are not energized. The reason is not entirely clear but some of the factors that appear to be involved are an ionized cloud of air surrounding the energized stylus and extending to neighboring styli and also capacitive coupling between the styli. The invention resolves the dot control problem by maintaining an intermediate residual voltage on unenergized styli rather than returning them to ground potential as was previously done. This reduces the potential difference between energized styli and neighboring styli and thereby reduces the interaction between them.

The intermediate voltage can be applied to styli by an active circuit that includes a voltage source that is coupled to all the styli. A set of impedance elements serves to isolate sets of styli from each other and also isolate the voltage source from the voltage source that is used to energize the styli. I prefer, however, to use a passive arrangement in which zener diodes are connected between the energizing sources and the styli. A residual capacitance associated with the styli is charged to the energizing voltage when it is applied to them. The zener diode permits this residual capacitance to discharge only down to the desired intermediate voltage when the styli are deenergized. The stray capacitance then maintains the intermediate voltage on the deenergized styli until they are again energized.

The preferred embodiment of the invention, as shown in in the FIGURE, makes use of the fact that associated with each set of styli 12 is a stray capacitance Cs. This capacitance Cs charges to the potential of the voltage pulses from the voltage source 10 and in prior printers discharges to ground potential through the terminal 10B on termination of each of the pulses. The circuit of the FIGURE includes a zener diode 14 connected between the terminal 10B and the styli 12. When the styli 12 are first energized the capacitance Cs charges to the pulse voltage as in the prior printers. However upon termination of the pulses the capacitance Cs can discharge only to the level permitted by the zener diode 14, thereby maintaining the styli 12 at the desired intermediate voltage when they are deenergized. This provides the same advantages as the circuit in the Figure with regard to the control of the sizes and shapes of the imprinted dots.

BRIEF DESCRIPTION OF THE DRAWING

This invention is pointed out with particularity in the appended claims. The above and further advantages of this invention may be better understood by referring to the following description taken in conjunction with the accompanying drawing in which the FIGURE is a circuit diagram of the preferred embodiment of the invention.

DETAILED DESCRIPTION OF AN ILLUSTRATIVE EMBODIMENT

Figure 1:
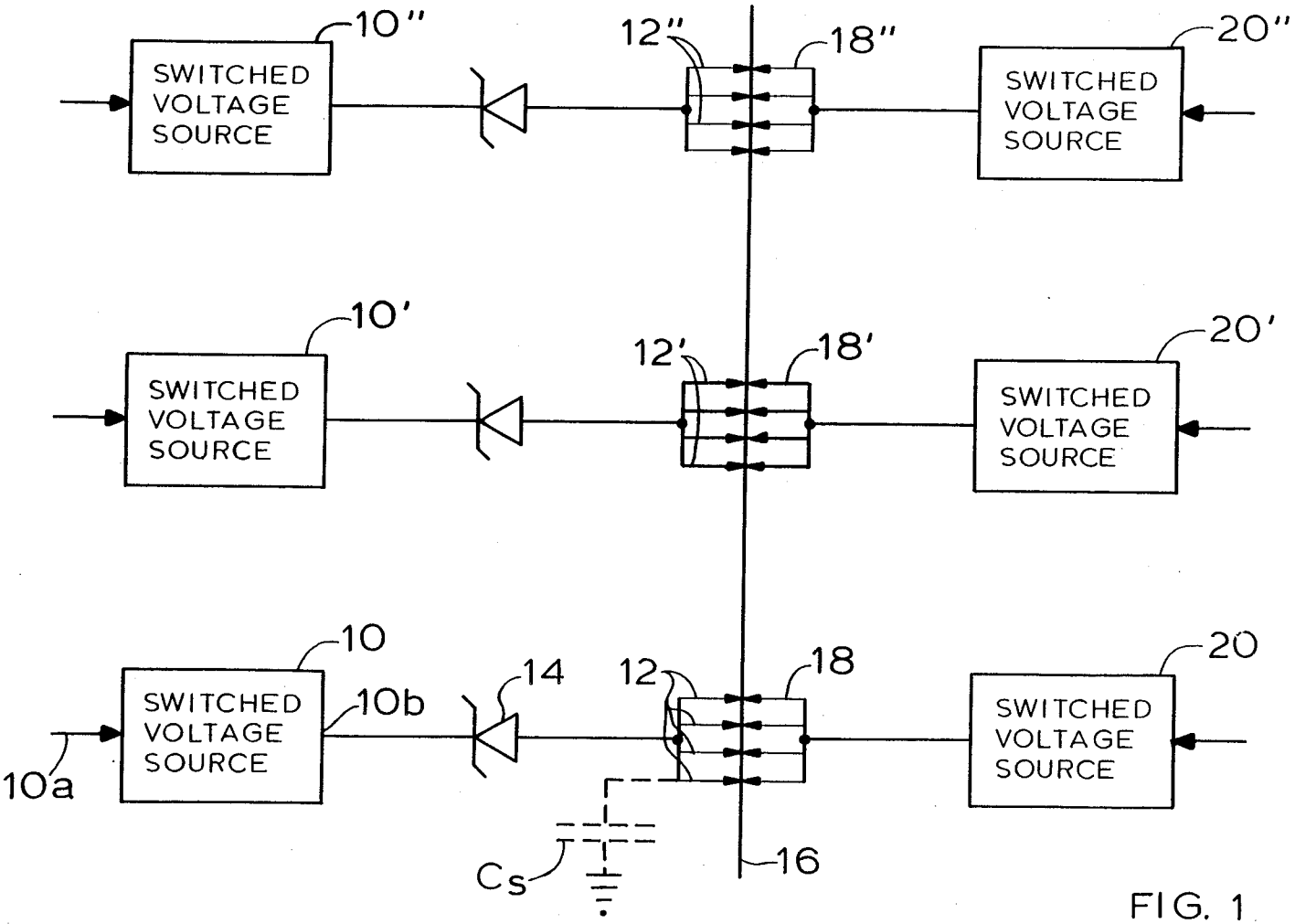

As shown in the drawing, an electrostatic printer incorporating the invention includes a set of switched voltage sources, one of which is shown at 10. In response to control pulses applied to an input terminal 10a, each of the sources 10 applies a high voltage pulse to a set of styli 12 coupled to an output terminal 10B. In the absence of an input pulse the output terminal 10B is returned essentially to ground potential by the source 10. The styli 12 are positioned to contact a sheet of recording paper 16 as do the styli 12' and 12'' connected to the other voltage sources 10' and 10''.

At the same time a set of backup electrodes 18, 18', and 18'' that contact the opposite surface of the recording sheet 16 are arranged in sets that are selectively energized by voltage sources 20, 20', 20'', whose polarity is opposite to that of the sources 10. For example, the output pulses of the source 10 may have a potential of −300 volts, and the backup electrodes 18 may be energized with a potential of +300 volts. By selectively pulsing the sources 10, 10' and 10'' and the sources 20, 20', and 20'' connected to the backup electrodes 18, 18', and 18'', individual "dots" of electric charge can be impressed on the recording sheet 16 in each of those locations where a stylus 12 and the opposing electrode 18 are simultaneously energized. Printers of this type are well known. An example of such a pritner is a Calcomp Model 5700 Electrostatic Printer/Plotter.

As shown in the drawing, there is a stray capacitance Cs between the styli 12 and ground. In accordance with the invention, the styli 12 are coupled to the source 10 by a zener diode 14, whose breakdown voltage is the desired intermediate voltage, e.g. 50 volts in the illustrative system. When the styli 12 are first energized the capacitance Cs charges up to the output voltage of the source 10. Upon termination of the pulse from source 10, this capacitance Cs discharges through the diode 14 and the source terminal **10*b*, until the voltage on the styli 12 reaches the breakdown voltage of diode 14. Discharge of the capactiance Cs then stops and the styli 12** are thus held at the intermediate voltage until they are again energized.

With the arrangement, the styli 12 do not interact appreciably with neighboring styli energized by other switched voltage sources even when styli 12 have been deenergized. This provides the desired control over the sizes and shapes of the dots imprinted by the system.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. An electrostatic printer comprising:

A. a plurality of switching voltage sources,

B. a plurality of styli positioned to contact a recording medium, each source being connected to a set of said styli, C. each voltage source being operative to apply pulses to energize the styli coupled thereto to a first voltage thereby to imprint on said medium dots of electric charge, and D. means for maintaining the unenergized styli at an intermediate voltage whose magnitude is less than said first voltage so as to substantially prevent interaction between energized and unenergized styli and thereby maintain control the size and shape of said dots.

2. The printer defined in claim 1 in which said means for maintaining unenergized styli at an intermediate voltage comprises a zener diode connected between each of said switching voltage sources and the styli energized thereby.

* * * * *